US006178300B1

(12) United States Patent
Lee et al.

(10) Patent No.: US 6,178,300 B1
(45) Date of Patent: Jan. 23, 2001

(54) PHOTORECEPTOR WEB GROUNDING STRUCTURE OF LIQUID ELECTROPHOTOGRAPHIC PRINTER

(75) Inventors: Jong-chan Lee, Suwon; Min-soo Lee, Ueiwang, both of (KR)

(73) Assignee: Samsung Electronics Co., Ltd., Kyungki-do (KR)

( * ) Notice: Under 35 U.S.C. 154(b), the term of this patent shall be extended for 0 days.

(21) Appl. No.: 09/474,000

(22) Filed: Dec. 29, 1999

(30) Foreign Application Priority Data

Jul. 1, 1999 (KR) ..... 99-26341

(51) Int. Cl.[7] ..... G03G 15/00

(52) U.S. Cl. ..... 399/90; 399/111; 399/116; 399/162

(58) Field of Search ..... 399/90, 111, 116, 399/162–165, 411; 361/225

(56) References Cited

U.S. PATENT DOCUMENTS 3,533,692 * 10/1970 Blanchette et al. .
5,436,696 * 7/1995 Orlowski et al. .
5,537,189 * 7/1996 Imes .
5,930,560 * 7/1999 Sawaki ..... 399/111

* cited by examiner

*Primary Examiner*—Richard Moses
(74) *Attorney, Agent, or Firm*—Sughrue, Mion, Zinn, Macpeak & Seas, PLLC

(57) ABSTRACT

A photoreceptor web grounding structure of a liquid electrophotographic printer for grounding a photoreceptor web installed in the printer, the structure includes a removable cartridge detachably installed in the printer, a first grounding brush installed at the removable cartridge and contacting the photoreceptor web, and a second grounding brush installed at a main frame to be in contact with the first grounding brush when the removable cartridge is installed in the printer. Thus, the first grounding brush installed at the removable cartridge is also replaced when the photoreceptor web is replaced so that replacement process due to contamination of the grounding brush can be very easily done.

5 Claims, 4 Drawing Sheets

100
200
120
110
240
235
231
110
120
10
110
120
G
250
260

221
211

PHOTORECEPTOR WEB GROUNDING STRUCTURE OF LIQUID ELECTROPHOTOGRAPHIC PRINTER

BACKGROUND OF THE INVENTION

1. Field of the Invention

The present invention relates to a structure for grounding a photoreceptor web installed at a liquid electrophotographic printer. The present application is based on Korean Patent Application No. 99-26341, which is incorporated herein by reference.

2. Description of the Related Art

A liquid electrophotographic printer such as a color laser printer, as shown in FIG. 1, includes a photoreceptor web 10, which circulates while being supported by a plurality of rollers 11, 12 and 13 installed at a belt unit in the printer. A predetermined electrostatic latent image is formed on one side of the photoreceptor web 10 by a laser scanner 16. The electrostatic latent image is developed into a colored image by a development unit 17. The developed image is dried as it passes a drying unit 14 and printed on a sheet of paper 1 at a transfer unit 15. Reference numerals 18 and 19 denote a charging device and a topping corona for applying a predetermined voltage to the photoreceptor web 10 for formation and removal of the electrostatic latent image, respectively. That is, the photoreceptor web 10 is charged to a high voltage by the topping corona 19 and a voltage of only a portion of the photoreceptor web 10 scanned by the laser scanner 16 drops. Thus, the electrostatic latent image is formed on the photoreceptor web 10 due to the difference in electric potential. After the image developed while passing the development unit 15 is printed on the paper 1, the image is charged by the charging device 18 and the voltage of the image formed on the photoreceptor web 10 changes to a normal state so that the electrostatic latent image is removed.

In order to charge the photoreceptor web 10 to a predetermined electric potential and maintain the electric potential, at least a portion of the photoreceptor web 10 must be grounded. That is, the grounded state enables maintenance of a relative voltage value.

According to the conventional technology, a grounding brush 20 fixed to a main frame (not shown) is provided so that one side of the photoreceptor web 10 is in contact with the grounding brush 20 when circulating. That is, the photoreceptor web 10 is grounded via the grounding brush 20 and the main frame.

However, as the photoreceptor web 10 is repeatedly contaminated with developer adhering thereto while printing, the grounding brush 20 contacting the photoreceptor web 10 gradually becomes contaminated with the developer. As the contamination becomes significant, the grounding brush 20 may lose its grounding effectiveness. When the contamination becomes serious, the grounding brush 20 is preferably replaced by a new one. However, as the grounding brush 20 is fixed at the main frame in the printer of the conventional structure, the procedure of disassembling and installing the grounding brush 20 to replace it is difficult as one must manually do these jobs while fitting one's hands through a narrow space of the printer, or alternatively, the printer itself must be disassembled. Hence, a structure that allows for the easy replacement of the grounding brush 20 is desired.

SUMMARY OF THE INVENTION

To solve the above problems, it is an objective of the present invention to provide an improved photoreceptor web grounding structure of a liquid electrophotographic printer which enables replacement of a grounding brush easily and quickly.

Accordingly, to achieve the above objective, there is provided a photoreceptor web grounding structure of a liquid electrophotographic printer for grounding a photoreceptor web installed in the printer, which comprises a removable cartridge detachably installed in the printer, a first grounding brush installed at the removable cartridge and contacting the photoreceptor web, and a second grounding brush installed at a main frame to be in contact with the first grounding brush when the removable cartridge is installed in the printer.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
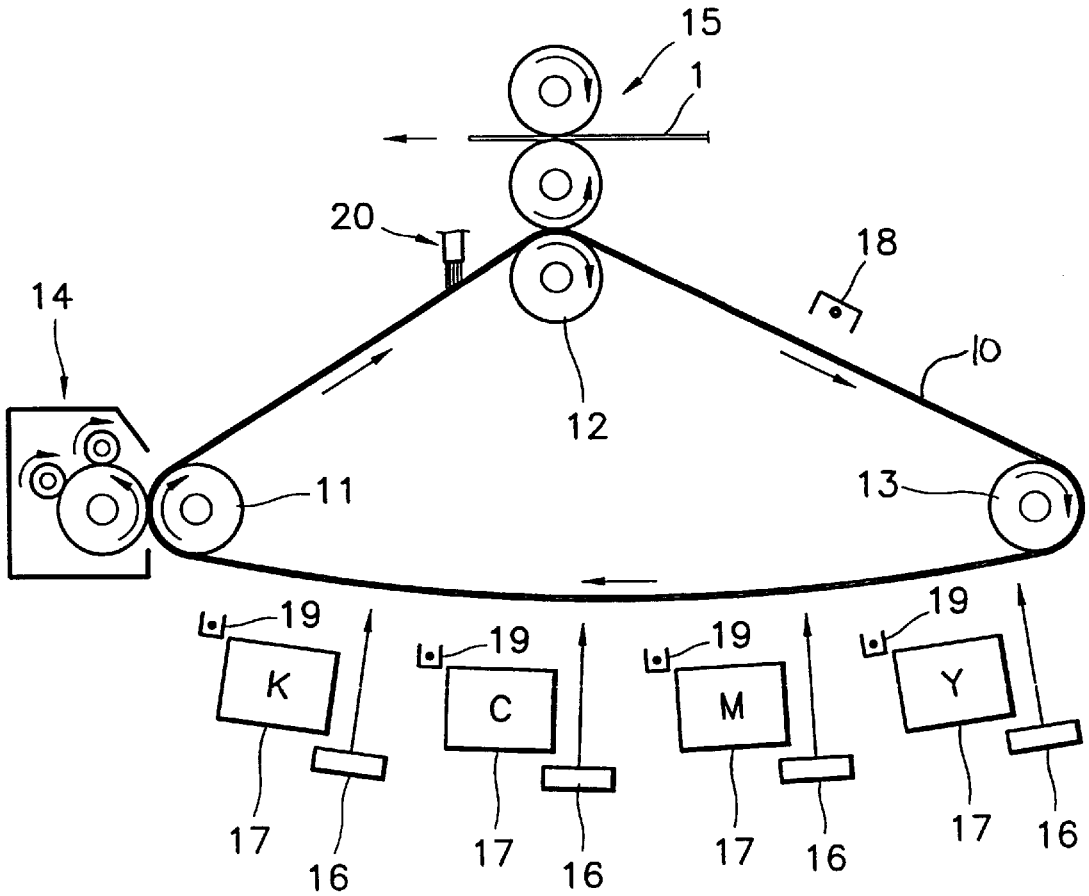
FIG. 1 (PRIOR ART)
FIG. 1 is a view showing the structure of a printer adopting a conventional photoreceptor web grounding structure.
Figure 2:
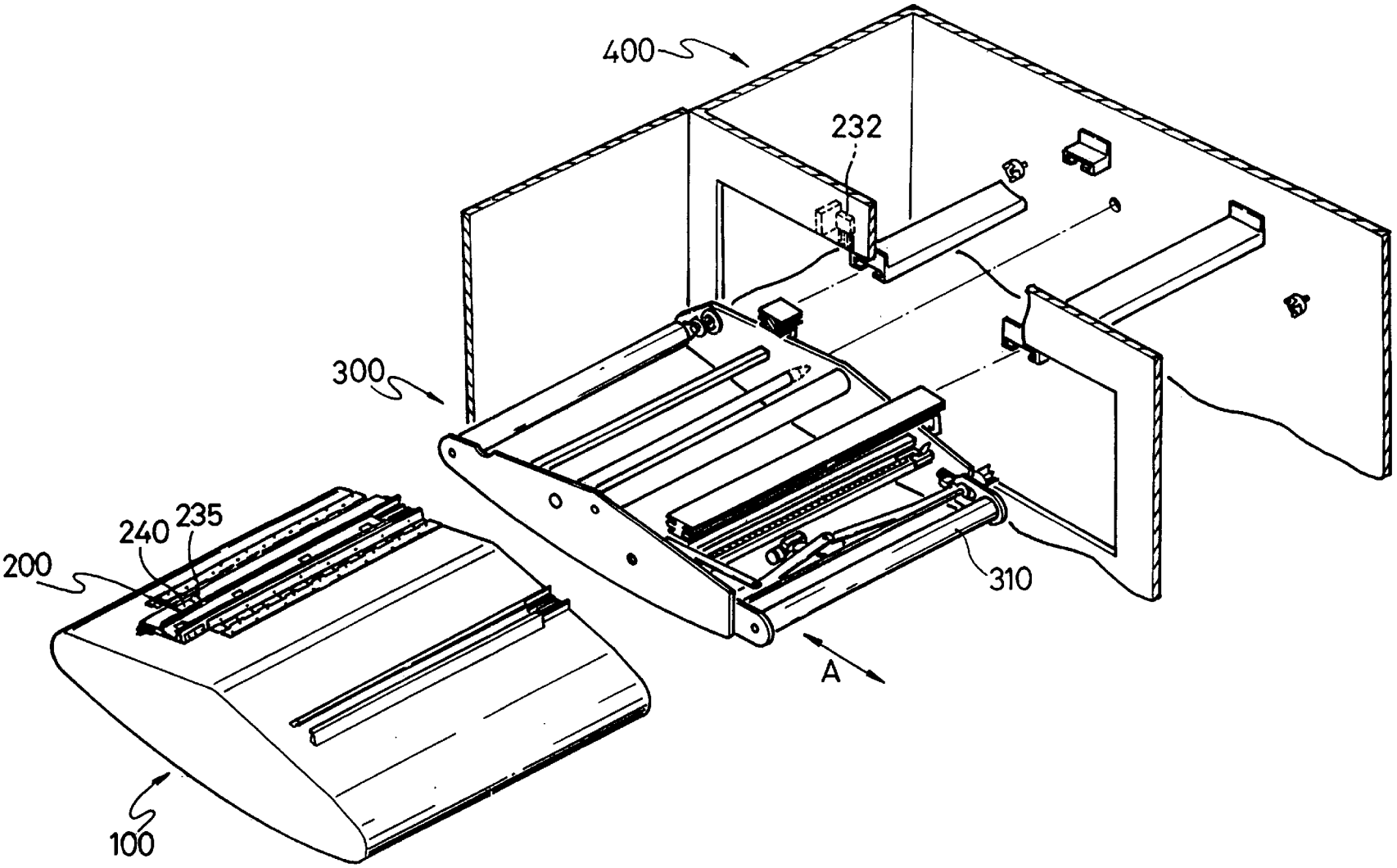
FIG. 2 is a perspective view showing the structure of a printer adopting a photoreceptor web grounding structure according to the present invention and photoreceptor web cartridge.
Figures 3A, 3B:
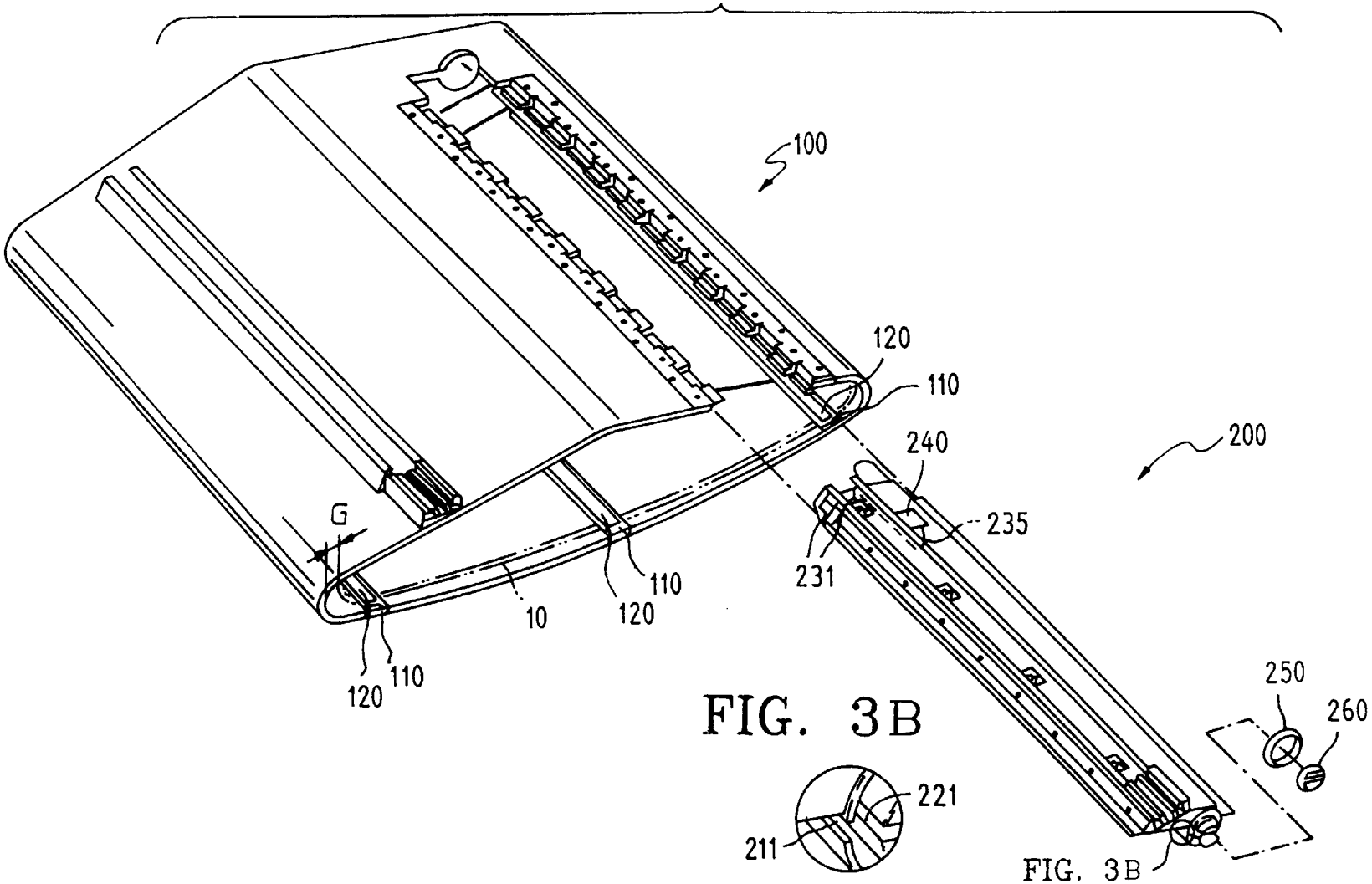
FIG. 3 is an exploded perspective view showing the photoreceptor web cartridge shown in FIG. 2.

Referring to FIGS. 2 and 3, a printer according to the present invention is provided with a main frame 400 and a belt unit 300, installed at the main frame 400, where a photoreceptor web 10 is installed. The photoreceptor web 10 circulates along an endless path while being supported by the belt unit 300. Reference numerals 100 and 200 denote a main cartridge and a removable cartridge forming a photoreceptor web cartridge, respectively. The main cartridge 100 and the removable cartridge 200 are detachably coupled as shown in FIG. 3. The photoreceptor web 10 is accommodated in the photoreceptor web cartridge and then installed at the belt unit 300. The photoreceptor web 10 penetrates slots 211 and 221, which are formed in the removable cartridge 200, and hence no interference with the photoreceptor web 10 occurs.

Figure 4:
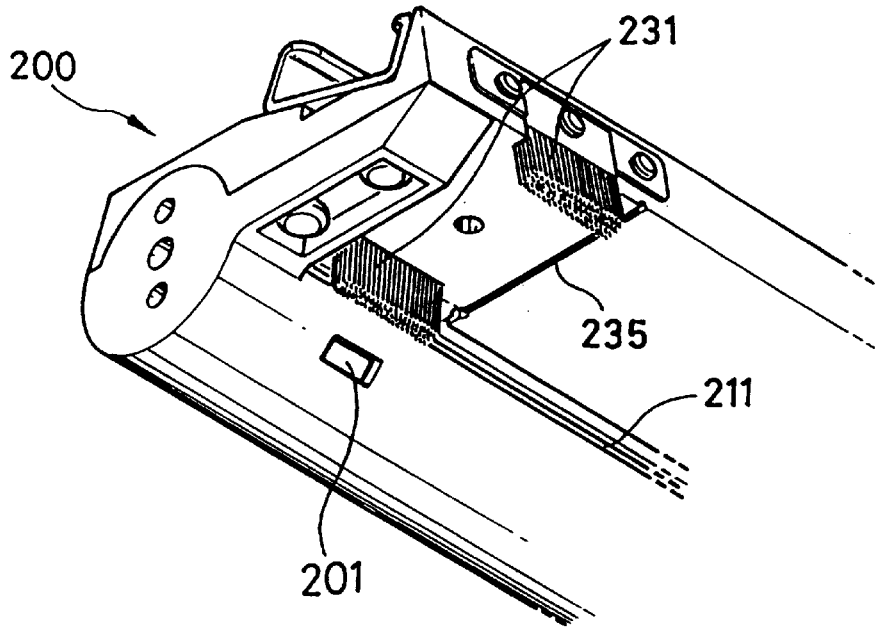
FIG. 4 is a view showing a removable cartridge of the photoreceptor web cartridge shown in FIG. 2.
Figure 5:
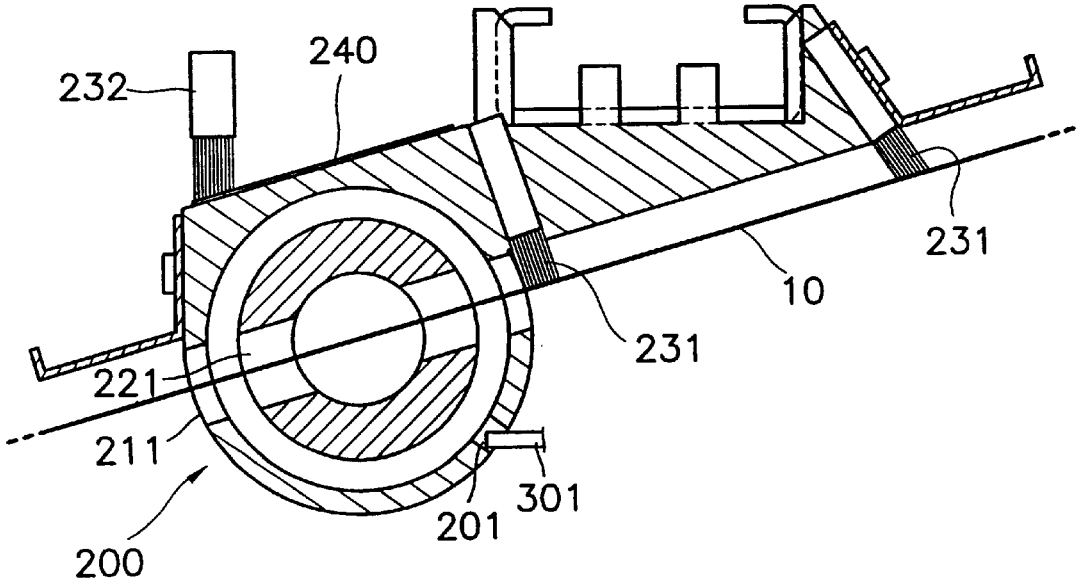
FIG. 5 is a view showing the state in which the photoreceptor web is grounded by the photoreceptor web grounding structure shown in FIG. 2.

The removable cartridge 200 is first coupled to the main cartridge 100, although FIG. 3 shows an imaginary state for the convenience of explanation in which the photoreceptor web 10 is accommodated in the main cartridge 100 without the removable cartridge 200. Next, the photoreceptor web 10 is loaded in the removable cartridge 200 via the slots 211 and 221, and then a cap member 250 and an elastic plate 260 are assembled. Thus, in the state in which the removable cartridge 200 and the main cartridge 100 are coupled, the photoreceptor web 10 is supported in the photoreceptor web cartridge. Reference numerals 110 and 120 denote a magnet and a plate member, respectively, for supporting the photoreceptor web 10 by inserting the photoreceptor web 10 between the magnet 110 and the plate member 120. Reference numeral 310 denotes one of the rollers of the belt unit 300 for supporting the photoreceptor web 10. Roller 310 is capable of reciprocating as indicated by arrow A shown in the drawing and allows the photoreceptor web 10 to be locked at the belt unit 300. That is, when the photoreceptor cartridge is inserted in the printer, the roller 310 moves and pushes the photoreceptor web 10 as far as extra space G in the main cartridge 100 as shown in FIG. 3, thus applying a tension force to the photoreceptor web 10. Thus, the photoreceptor web 10 is confined by the belt unit 300 by the tension force and thereafter only the main cartridge 100 is removed, leaving the photoreceptor web 10 installed on the belt unit 300. Also, a locking groove 201 is formed in the removable cartridge 200 as shown in FIGS. 4 and 5. A locking pin 301, provided at the belt unit 300, is inserted in the locking groove 201 when the photoreceptor web is inserted. Thus, the removable cartridge 200 is locked in the belt unit 300.

In this state, when the photoreceptor web 10 is installed at the belt frame 300, the photoreceptor web cartridge where the photoreceptor web 10 is accommodated is inserted in the printer. When the photoreceptor web cartridge is completely inserted, the photoreceptor web 10 and the removable cartridge 200 are locked in the belt frame 300 and thereafter only the main cartridge 100 is removed so that the photoreceptor web 10 is installed.

As shown in FIGS. 3 through 5, a first grounding brush 231 for grounding the photoreceptor web 10 is installed at the removable cartridge 200 which is installed at the belt frame 300 with the photoreceptor web 10. The first grounding brush 231 is fixed to the removable cartridge 200 and maintains contact with the photoreceptor web 10. Reference numeral 240 denotes a contact portion provided at the upper surface of the removable cartridge 200 which is connected to the first grounding brush 231 by a coupling wire 235. The contact portion 240 is formed of a conductive material such as an aluminum tape. Also, a second grounding brush 232 is installed at the main frame 400, as shown in FIGS. 2 and 5, which contacts the contact portion 240 as the removable cartridge 200 is installed at the belt frame 300. Thus, when the photoreceptor web 10 and the removable cartridge 200 are installed at the belt frame 300, the second grounding brush 232 contacts and is electrically connected to the contact portion 240 so that a grounding path is formed from the photoreceptor web 10 to the main frame 400. Accordingly, the photoreceptor web 10 is grounded and a charging process for development can be performed.

In the structure of the present invention, as the first grounding brush 231 contacts the photoreceptor web 10, only the first grounding brush 231 is contaminated as printing repeats. As the second grounding brush 232 contacts the contact portion 240 provided at the upper surface of the removable cartridge 200, contamination due to developer adhering to the photoreceptor web 10 does not occur. Thus, when grounding performance is lowered as the contamination becomes critical, only the first grounding brush 231 need be replaced. As the first grounding brush 231 is installed at the removable cartridge 200, which is detachably assembled in the belt frame 300 with the photoreceptor web 10, the first grounding brush 231 can be easily replaced by removing it with the removable cartridge 200 whenever the photoreceptor web 10 is replaced. When a new photoreceptor web 10 is reinstalled, as the removable cartridge 200 is replaced by a new removable cartridge having a new grounding brush, no additional process for replacement of the first grounding brush 231 is needed.

As the structure of the present invention is a double grounding configuration in which the first grounding brush 231 directly contacting the photoreceptor web 10 is installed at the removable cartridge 200, which is detachably assembled to the belt frame 300, and the second grounding brush 232 installed at the main frame 400 is connected to the first grounding brush 231 via the contact portion 240 formed at the upper surface of the removable cartridge 200, a replacement process due to contamination of the grounding brush can be very easily performed.

Although a brush is used as a medium for grounding of the photoreceptor web in the present embodiment, a conductive leaf spring exhibiting elasticity can be used, in particular, as the second grounding brush 232.

As described above, in the photoreceptor web grounding structure of a liquid electrophotographic printer according to the present invention, as the double grounding structure is employed, wherein the first grounding brush is installed at the removable cartridge to be replaced with the photoreceptor web and the second grounding brush connected to the first grounding brush is installed at the main frame, the first grounding brush installed at the removable cartridge is replaced when the photoreceptor web is replaced. Thus, replacement process due to contamination of the grounding brush can be very easily performed.

The above description of the preferred embodiments has been given by way of example. From the disclosure given, those skilled in the art will not only understand the present invention and its attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A photoreceptor web grounding structure for grounding a photoreceptor web installed in a liquid electrophotographic printer, the photoreceptor web grounding structure comprising:

a removable cartridge detachably installed in the liquid electrophotographic printer;

a first grounding brush installed on the removable cartridge and contacting the photoreceptor web; and a second grounding brush, installed at a main frame of the liquid electrophotographic printer, for contacting the first grounding brush when the removable cartridge is installed in the liquid electrophotographic printer.

2. The photoreceptor web grounding structure as claimed in claim 1, wherein the removable cartridge is provided with a contact portion electrically connected to the first grounding brush so that the second grounding brush contacts the first grounding brush via the contact portion.

3. A photoreceptor web grounding structure for grounding a photoreceptor web installed in a liquid electrophotographic printer, the photoreceptor web grounding structure comprising:

a belt unit having slidable rollers for applying tension to the photoreceptor web in order to support the photoreceptor web installed in the liquid electrophotographic printer;

a main cartridge for temporarily supporting the photoreceptor web and installing the photoreceptor web onto the belt unit;

a removable cartridge, which is temporarily detachably installed in the main cartridge and then detachably installed in the liquid electrophotographic printer;

a first grounding element installed on the removable cartridge, wherein the first grounding element contacts the photoreceptor web when the photoreceptor web and the removable cartridge are installed in the liquid electrophotographic printer; and a second grounding element attached to a main frame of the liquid electrophotographic printer, wherein the second grounding element contacts the first grounding brush when the removable cartridge is installed in the liquid electrophotographic printer;

wherein an electrical grounding path for grounding the photoreceptor web is comprised by the first grounding element, the second grounding element, and the main frame of the liquid electrophotographic printer.

4. The photoreceptor web grounding structure as claimed in claim 3, wherein the electrical grounding path further comprises:

a contact surface electrically connected to the first grounding element and provided on the removable cartridge, wherein the second grounding element contacts the first grounding element via the contact surface.

5. The photoreceptor web grounding structure as claimed in claim 3, wherein each of the first and second grounding elements is a conductive brush or a conductive leaf spring.

* * * * *